US010897673B2

(12) United States Patent
Fujitani

(10) Patent No.: US 10,897,673 B2
(45) Date of Patent: Jan. 19, 2021

(54) DIAPHRAGM, SPEAKER UNIT USING SAME, HEADPHONES, AND EARPHONES

(71) Applicant: Onkyo Corporation, Osaka (JP)

(72) Inventor: Takeshi Fujitani, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 16/587,387

(22) Filed: Sep. 30, 2019

(65) Prior Publication Data

US 2020/0112794 A1 Apr. 9, 2020

(30) Foreign Application Priority Data

Oct. 9, 2018 (JP) ..... 2018-191159

(51) Int. Cl.

| | |
|---|---|
| ***H04R 9/06*** | (2006.01) |
| ***H04R 1/10*** | (2006.01) |
| ***H04R 31/00*** | (2006.01) |
| ***H04R 7/18*** | (2006.01) |
| ***H04R 9/02*** | (2006.01) |
| ***H04R 7/12*** | (2006.01) |

(52) U.S. Cl.

CPC ..... *H04R 9/06* (2013.01); *H04R 1/10* (2013.01); *H04R 7/127* (2013.01); *H04R 7/18* (2013.01); *H04R 9/025* (2013.01); *H04R 31/003* (2013.01)

(58) Field of Classification Search

CPC . H04R 9/06; H04R 1/10; H04R 7/127; H04R 7/18; H04R 9/025; H04R 31/003

USPC ..... 381/396

See application file for complete search history.

(56) References Cited

U.S. PATENT DOCUMENTS

| | | | | |
|---|---|---|---|---|
| 6,611,604 | B1 * | 8/2003 | Irby | H04R 7/122 181/171 |
| 6,697,496 | B2 * | 2/2004 | Frasl | H04R 7/20 181/171 |
| 6,957,714 | B2 * | 10/2005 | Takahashi | H04R 7/20 181/171 |
| 8,094,864 | B2 * | 1/2012 | Inaba | H04R 7/20 381/398 |
| 8,139,812 | B2 * | 3/2012 | Basnet | H04R 9/043 381/398 |
| 8,682,021 | B2 * | 3/2014 | Kosuda | H04R 7/06 381/398 |

(Continued)

FOREIGN PATENT DOCUMENTS

| | | |
|---|---|---|
| JP | 57-200996 U1 | 12/1982 |
| JP | 62-139191 U1 | 9/1987 |
| JP | 09-224297 A | 8/1997 |

*Primary Examiner* — Sean H Nguyen

(57) ABSTRACT

Displacement symmetry of a diaphragm is improved to prevent the occurrence of troubles such as diaphragm rolling or the occurrence of abnormal noise, thereby providing high reproduced sound quality. The diaphragm includes an annular edge portion having a convex radial cross section formed by molding a sheet-like member or a film-like member. The edge portion has a plurality of rotationally symmetrical recessed ribs formed by recessing a convex surface. The plurality of recessed ribs includes at least a first rib disposed along a first prescribed line intersecting, at an angle of 45°, a first radial line passing a center point, and a second rib arranged in a position not intersecting but adjacent to the first rib and disposed along a second prescribed line intersecting the second radial line at a predetermined angle of less than 45°.

8 Claims, 10 Drawing Sheets

(56) References Cited

U.S. PATENT DOCUMENTS

| | | | | |
|---|---|---|---|---|
| 10,499,157 | B2 * | 12/2019 | Wu | H04R 7/127 |
| 10,779,087 | B2 * | 9/2020 | Wu | H04R 7/16 |
| 2004/0238267 | A1 * | 12/2004 | Sakamoto | H04R 7/18<br>181/157 |
| 2009/0052726 | A1 * | 2/2009 | Hatanaka | H04R 9/045<br>381/431 |
| 2016/0227314 | A1 * | 8/2016 | Cai | H04R 1/021 |
| 2020/0145760 | A1 * | 5/2020 | Kikuchi | H04R 9/06 |

* cited by examiner

DIAPHRAGM, SPEAKER UNIT USING SAME, HEADPHONES, AND EARPHONES

BACKGROUND OF THE INVENTION

1. Field of the Invention

The present invention relates to a diaphragm of an electrodynamic speaker unit used in headphones and earphones which are worn on a user's ears for audio reproduction.

2. Description of the Related Art

In a small-sized electrodynamic speaker unit for use in headphones and earphones, a diaphragm may be used in which a dome portion and an edge portion extending from the outer periphery of the dome portion are integrally configured by molding a film-like member made of a resin material, such as polyethylene terephthalate (PET) or polyetherimide (PEI). In the electrodynamic speaker, a voice coil to which an audio signal current is supplied from the back side is mounted to a connected portion of the dome portion at the center of the diaphragm and the edge portion, which are integrally configured. The outer peripheral end side of the edge portion of the diaphragm is fixed to a frame linked with a small and lightweight magnetic circuit, and the coils of the voice coil are disposed in a magnetic gap of a magnetic circuit.

The shape of the diaphragm affects the quality and the sound pressure frequency characteristics of audio reproduction by the electrodynamic speaker unit. Particularly in the case of the diaphragm in which the dome portion and the edge portion are integrally molded, there have been many examples in which a convex (roll-shaped) edge portion is fitted with a plurality of ribs (projections or grooves) to adjust the vibration characteristics of the edge portion as it vibrates vertically and deforms. For example, JP-UM-A-57-200996 discloses a speaker diaphragm in which a plurality of ribs is formed between the inner periphery and the outer periphery and extends from the inner periphery contactlessly along curved lines and at regular intervals.

JP-UM-A-62-139191 discloses an acoustic reproduction diaphragm that has a roll-shaped edge. In the diaphragm, a plurality of arc-shaped grooves or projections is disposed along the entire curved surface of the edge so as not to overlap each other. The arc-shaped grooves or projections pass a total of three points including: points A, B of intersection of a tangent to the inner periphery of the edge and the inner and outer peripheries of the edge; and a point C which is on a circumference bisecting the distance between the inner periphery and the outer periphery of the edge and is equally spaced from the intersection points A, B.

JP-A-9-224297 discloses an acoustic converter diaphragm in which tangential edges are formed. In the acoustic converter diaphragm, circumferential ribs are provided between the tangential edges on the diaphragm.

The edge portion having a plurality of ribs in diagonal directions illustrated in FIG. 1 or FIG. 2 of JP-UM-A-57-200996, or the edge according to JP-A-9-224297 may be referred to as a tangential edge. The ribs illustrated in FIG. 2 or FIG. 4 of JP-UM-A-57-200996 have a cross section such that the base material is bent so as to be linearly angled, whereby the edge portion of the diaphragm is bent at acute angles at the ribs. As discussed in JP-UM-A-62-139191, when the diaphragm vibrates vertically, if the ease of motion of the edge portion varies between the up direction and the down direction, that is, if the displacement symmetry of the edge portion varies and the linearity of the diaphragm deteriorates, troubles such as diaphragm rolling or the occurrence of abnormal noise become more likely to occur. If the displacement symmetry of the edge portion varies, the likelihood of an increase in the even-order distortion of sound waves emitted from the electrodynamic speaker unit increases, resulting in degradation of the reproduced sound quality.

The present invention has been made to solve the problems of the prior art, and an object of the present invention is to improve, with respect to a diaphragm of an electrodynamic speaker unit used in headphones and earphones, the displacement symmetry of the diaphragm to prevent troubles, such as diaphragm rolling or the occurrence of abnormal noise, and to provide a speaker unit having high reproduced sound quality.

SUMMARY OF THE INVENTION

A diaphragm according to the present invention is a diaphragm including an annular edge portion having a convex radial cross section formed by molding a sheet-like member or a film-like member. The edge portion includes a plurality of rotationally symmetrical recessed ribs formed by recessing a convex surface. The plurality of recessed ribs includes at least a first rib disposed along a first prescribed line intersecting, at an angle of 45°, a first radial line passing a center point, and a second rib which is disposed in a position not intersecting but adjacent to the first rib, and which is disposed along a second prescribed line intersecting a second radial line at a predetermined angle of less than 45°.

Preferably, in the diaphragm of the present invention, the plurality of recessed ribs may further include one or a plurality of the second ribs arranged adjacent to each other by replicating the second rib rotationally symmetrically by a predetermined angle from the center point, in which a second rib group of the plurality of adjacent second ribs may be disposed between at least two of the first ribs in the edge portion.

Preferably, in the diaphragm of the present invention, the plurality of recessed ribs may further include one or a plurality of the first ribs arranged adjacent to each other by replicating the first rib rotationally symmetrically by a predetermined angle from the center point, in which a first rib group of the plurality of adjacent first ribs may be disposed between at least two of the second ribs in the edge portion.

Preferably, in the diaphragm of the present invention, a dome portion configured from a member different from the sheet-like member or the film-like member and having a convex radial cross section may be linked with a central side of the edge portion.

Preferably, in the diaphragm of the present invention, a dome portion having a convex radial cross section may be configured on the central side of the edge portion integrally with the edge portion by molding the sheet-like member or the film-like member.

Preferably, the diaphragm of the present invention may further include a voice coil linked with a voice coil attachment portion defined on an outer peripheral portion of the dome portion.

A speaker unit according to the present invention includes the diaphragm; a frame to which an outer peripheral end portion of the edge portion of the diaphragm is fixed; a terminal which is fixed to the frame and to which a coil of the voice coil is connected; a magnetic circuit including a magnetic gap in which the coil of the voice coil is disposed, the magnetic circuit being fixed to the frame; and a braking member mounted so as to cover an opening of a window portion of the frame.

A headphone or earphone according to the present invention includes the speaker unit.

In the following, the operation of the present invention will be described.

The diaphragm of the present invention is a diaphragm that configures an electrodynamic speaker unit used in headphones or earphones, and that includes the edge portion having a convex radial cross section obtained by molding a sheet-like member or film-like member. The diaphragm of the present invention may further include the dome portion formed of another material or the same material on the central side of the edge portion, and the voice coil linked with the voice coil attachment portion defined on the outer peripheral portion of the dome portion. The speaker unit of the present invention may include the diaphragm, the frame to which the outer peripheral end portion of the edge portion of the diaphragm is fixed, the terminal which is fixed to the frame and to which the coil of the voice coil is connected, the magnetic circuit that has a magnetic gap with the coil of the voice coil disposed therein and that is fixed to the frame, and the braking member mounted so as to cover the opening of the window portion of the frame, and may configure headphones or earphones.

In the edge portion of the diaphragm, a plurality of recessed ribs formed by recessing a convex surface is rotationally symmetrically arranged so as to extend in directions inclined with respect to the respective radial lines passing the center point. The plurality of recessed ribs includes at least the first rib disposed along the first prescribed line intersecting, at the angle of 45°, the first radial line passing the center point, and the second rib arranged in a position not intersecting but adjacent to the first rib, and disposed along the second prescribed line intersecting the second radial line at a predetermined angle of less than 45°. The first prescribed line is also a tangent to a concentric circle around the center point. Accordingly, the first rib disposed along the first prescribed line forms a tangential rib. The second rib forms an inclined rib inclined with respect to the first rib that is the tangential rib.

Thus, compared to when conventional tangential ribs are provided, the inclined rib is additionally provided. Accordingly, the displacement symmetry of the edge portion of the diaphragm can be improved and made substantially symmetric. Further, the first rib (tangential rib) and the second rib (inclined rib) having different inclination angles with respect to the radial line are disposed adjacent to each other, so that it is possible to obtain the effect of resonance dispersion in high-frequency ranges. As a result, it is possible to suppress diaphragm rolling or the occurrence of abnormal noise, suppress even-order distortion, and obtain excellent reproduced sound quality.

Preferably, in the diaphragm of the present invention, the plurality of recessed ribs may further include one or a plurality of the second ribs arranged adjacent to each other by replicating the second rib rotationally symmetrically by a predetermined angle from the center point, and a second rib group of a plurality of the adjacent second ribs may be disposed between at least two first ribs in the edge portion. Further, the plurality of recessed ribs may further include one or a plurality of the first ribs arranged adjacent to each other by replicating the first rib rotationally symmetrically by a predetermined angle from the center point, and a first rib group of a plurality of the adjacent first ribs may be disposed between at least two second ribs in the edge portion. In this way, it is possible to further improve the displacement symmetry of the edge portion.

With the diaphragm for an electrodynamic speaker unit used in headphones and earphones according to the present invention, it is possible to provide headphones and a speaker unit in which the displacement symmetry of the diaphragm having the dome portion and the edge portion integrally molded is improved, and the occurrence of troubles such as diaphragm rolling or the occurrence of abnormal noise is prevented, thereby providing high reproduced sound quality.

DETAILED DESCRIPTION OF THE PREFERRED EMBODIMENTS

In the following, a diaphragm or a dust cap and a speaker unit according to preferred embodiments of the present invention will be described. However, the present invention is not limited to the embodiments.

First Embodiment

Figure 1:
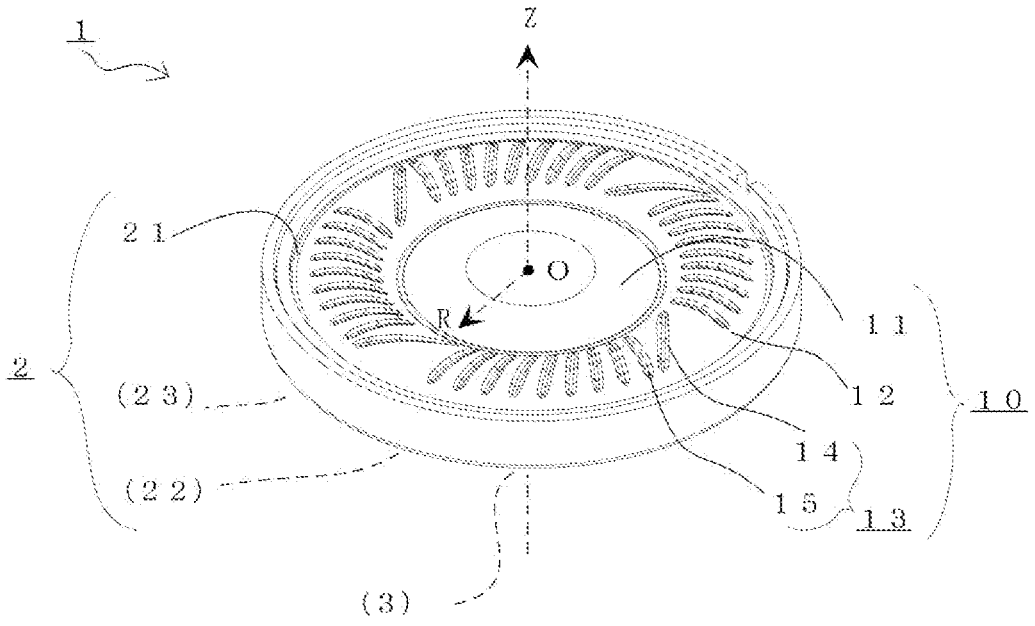
FIG. 1 is an external view of an electrodynamic speaker unit used in headphones and earphones according to an embodiment of the present invention.
Figure 2:
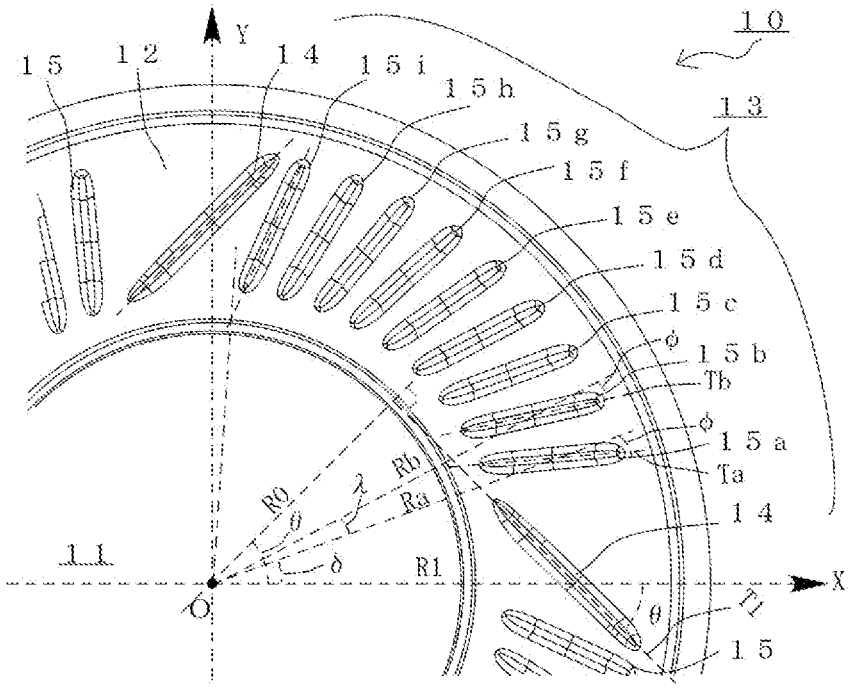
FIG. 2 is a plan view for describing the shape of a diaphragm according to an embodiment of the present invention.

FIG. 1 is a diagram for describing an electrodynamic speaker unit 1 used in headphones and earphones according to a preferred embodiment of the present invention. Specifically, FIG. 1 is a perspective view from the front side, illustrating the appearance of the speaker unit 1. FIG. 2 is a partially enlarged plan view for describing the shape of the diaphragm 10 of the speaker unit 1. The form of the speaker unit 1 is not limited to the case of the present embodiment. Diagrammatic depiction and description of the configuration of the speaker unit 1 that is not required for describing the present invention are omitted.

The speaker unit 1 of the present embodiment is an electrodynamic speaker with a nominal diameter of 40 mm which is used in headphones disposed in proximity to a user's ears. The speaker unit 1 of the present embodiment is suitable for headphones when the nominal diameter is 35 to 50 mm, for example. When the nominal diameter is smaller, such as 5 to 10 mm, the speaker unit 1 is suitable for earphones. The speaker unit 1 is mounted to the baffle of the headphones or to the housing of the earphones to configure the headphones or earphones. Diagrammatic depiction and description of the concrete form of the headphones or earphones in which the speaker unit 1 is used are omitted.

The speaker unit 1 is provided with: a frame 2 formed from resin material; a magnetic circuit 3 (not depicted) fixed to the frame 2; a diaphragm 10 obtained by molding a film-like polyethylene terephthalate (PET) member; a voice coil (not depicted) which is linked with the diaphragm 10 and of which a coil (not depicted) is disposed in a magnetic gap (not depicted) of the magnetic circuit 3; terminals (not depicted) to which the ends of the coil of the voice coil are connected; and a braking member (not depicted) which is mounted to the frame 2 and through which sound waves emitted from the diaphragm 10 pass. The magnetic circuit 3, the voice coil, and the braking member, which covers an opening to be described later of the frame 2, are positioned and hidden on the back side of the diaphragm 10, and are therefore not visible in FIG. 1.

The diaphragm 10 includes a dome portion 11 forming a part of a spherical surface, and an edge portion 12 extending from the outer periphery of the dome portion 11, the dome portion 11 and the edge portion 12 being integrally configured. The voice coil, to which an audio signal current is supplied from the back side, is mounted to the outer periphery portion of the dome portion 11 to which the edge portion 12 joins. The outer peripheral end side of the edge portion 12 of the diaphragm 10 is fixed to a diaphragm fixing portion 21 of the frame 2. The magnetic circuit 3, which is small and lightweight, is fixed to a magnetic circuit fixing portion 22 (not depicted) of the frame 2. On the inside of the magnetic circuit fixing portion 22, an opening which communicates with the magnetic gap of the magnetic circuit 3 and through which the voice coil passes is provided. The coil of the voice coil linked with the diaphragm 10 is disposed in the magnetic gap of the magnetic circuit 3.

Thus, in the speaker unit 1, when an audio signal current is supplied to the voice coil disposed in the magnetic gap of the magnetic circuit 3 in which a strong DC magnetic field is being generated, a drive force is generated in the Z-axis direction indicated in the drawings, and the speaker vibration system configured from the voice coil and the diaphragm 10 vibrates in the Z-axis direction. That is, the speaker vibration system is only supported by the edge 12 of the diaphragm 10 so as to be able to vibrate, so that a pressure change is caused in the air existing to the front and rear of the diaphragm 10, and the audio signal current is converted into sound waves (audio).

The frame 2 includes: the substantially annular-shaped diaphragm fixing portion 21 fixing the outer peripheral portion of the edge portion 12 of the diaphragm 10; the substantially annular-shaped magnetic circuit fixing portion 22 fixing the magnetic circuit 3; a linking portion 23 (not depicted) linking the diaphragm fixing portion 21 and the magnetic circuit fixing portion 22 and defining a plurality of openings (not depicted); and a terminal fixing portion (not depicted) fixing the terminals. The frame 2 is fitted with the dome portion 11 of the diaphragm 10 and the edge portion 12 that are exposed on the front side thereof, and is configured so that the sound waves emitted from the front side of the diaphragm 10 can be reproduced.

Further, the frame 2 is configured, with respect to the sound waves emitted from the backside of the diaphragm 10 that have an opposite-phase relationship with the sound waves emitted from the front side of the diaphragm 10, so that sound waves from the edge portion 12 are reproduced on the back side via the plurality of openings (not depicted) defined in the linking portion 23. The linking portion 23 may be fitted with a breathable braking member (not depicted) covering the openings. In the speaker unit 1, the compliance (acoustic capacity) due to the internal space of the frame 2 can be adjusted by the openings and the braking member so as to be suitable for the headphones or earphones. By adjusting the compliance, it is possible to adjust the frequency characteristics, particularly the frequency characteristics in the lower frequency range.

The frame 2 is formed from a resin material containing a polyphenylene ether resin, a polystyrene resin, and at least one polyolefin resin selected from the group consisting of polyethylene, polypropylene, and ethylene-propylene copolymers. Preferably, the weight ratio of the polyphenylene ether resin and the polystyrene resin is in a range of 90/10 to 70/30. Preferably, with respect to a total of 100 parts by weight of the polyphenylene ether resin and the polystyrene resin, 5 to 20 parts by weight of the polyolefin resin is contained. The polyphenylene ether resin and the polystyrene resin may be alloyed.

The frame 2 of the present embodiment, due to the adoption of the above resin material, has a high internal loss and excellent mechanical characteristics in a well-balanced manner, is lightweight, and provides excellent heat resistance and S/N ratio. More specifically, because a polyphenylene ether resin, a polystyrene resin, and a polyolefin resin are contained at specific ratios, it is possible to obtain the frame 2 that has a very high internal loss and excellent mechanical characteristics in a well-balanced manner, and that offers excellent vibration characteristics without adversely affecting the excellent heat resistance, moisture resistance, moldability, dimensional stability, and lightweight properties that the resins inherently possess.

The diaphragm 10 molds a film-like polyethylene terephthalate (PET) member with a thickness of 20 μm. The edge portion 12 of the diaphragm 10 is a roll edge having a convex cross section in the radial direction. As depicted in FIG. 1 or FIG. 2, the edge portion 12 has a plurality of recessed ribs 13 formed by recessing the convex surface. The plurality of recessed ribs 13 includes first ribs 14 which are tangential ribs, and second ribs 15 which are inclined ribs, in which the first ribs 14 and the second ribs 15 are arranged in the edge portion 12 rotationally symmetrically. In the edge portion 12 of the diaphragm 10 of the present embodiment, four first ribs 14 and 36 second ribs 15 are arranged as the recessed ribs 13.

Each of the recessed first ribs 14 is formed by recessing the convex surface of the edge portion 12 so as to be disposed along a first prescribed line T1 that intersects, at an angle θ=45°, a first radial line R1 passing the center point O. The first radial line R1 is a virtual line that passes the center, or around the center, of the first ribs 14. For example, as illustrated in FIG. 2, the intersecting first rib 14 intersecting the X-axis is formed as a groove recessed along the first prescribed line T1 intersecting the convex surface of the edge portion 12 at an angle θ=45° at a predetermined distance from the center point O along the first radial line R1 aligned with the X-axis.

The first prescribed line T1 defining the first ribs 14 is also a tangent to a concentric circle around the center point O. That is, the first prescribed line T1 is a tangent to the concentric circle that intersects, at an angle θ=90°, a radial line R0 at the angle θ=45° as illustrated. Accordingly, the first ribs 14 disposed along the first prescribed line T1 form tangential ribs of the edge portion 12.

As illustrated in FIG. 2, the first rib 14 intersecting the Y-axis is formed as a groove recessed along the first prescribed line intersecting, at an angle θ=45°, the convex surface of the edge portion 12 at a predetermined distance from the center point O along the first radial line aligned with the Y-axis as illustrated. The first rib 14 intersecting the Y-axis is a recessed rib replicated by rotating the first rib 14 intersecting the X-axis by 90° around the center point O. In the diaphragm 10, further two first ribs 14 intersecting the X-axis or the Y-axis are arranged similarly in a rotationally symmetrically replicated manner. As a result, a total of four first ribs 14 are arranged rotationally symmetrically at the angle of 90° from the center point O.

The recessed second ribs 15 are formed by recessing the convex surface of the edge portion 12 so as to be disposed along a second prescribed line intersecting a second radial line passing the center point O at an angle φ=15°. The second radial line is a virtual line that passes the center, or around the center, of the second ribs 15. For example, as illustrated in FIG. 2, the second rib 15*a* disposed in a position adjacent to and not intersecting the first rib 14 intersecting the X-axis is formed as a groove recessed along a second prescribed line Ta intersecting, at the angle φ=15°, the convex surface of the edge portion 12 at a predetermined distance from the center point O along a second radial line Ra passing the center point O and extending in the direction of an angle δ=20° from the X-axis.

Thus, the second prescribed line Ta defining the second rib 15*a* is not a tangent to the concentric circle around the center point O, and has an inclined-intersecting relationship with the first prescribed line T1 defining the adjacent first rib 14. Accordingly, the second rib 15*a* disposed along the second prescribed line Ta forms not a tangential rib of the edge portion 12 but an inclined rib not intersecting the first rib 14.

Next, as illustrated in FIG. 2, another second rib 15*b* is disposed in a position adjacent to the second rib 15*a* which is an inclined rib. Specifically, the second rib 15*b* is disposed so as to replicate the second rib 15*a* rotationally symmetrically spaced apart at an interval of an angle λ=7.5° from the center point O. Similarly, each of the other second ribs 15*c* to 15*i* is disposed so as to replicate rotationally symmetrically spaced apart at an interval of an angle λ=7.5°. As a result, the second ribs 15*a* to 15*i* form a rib group of nine second ribs. The rib group (second ribs 15*a* to 15*i*) is disposed between the first rib 14 disposed in the position intersecting the X-axis and the first rib 14 disposed in the position intersecting the Y-axis.

In the diaphragm 10 of the present embodiment, four groups of rib groups each consisting of nine second ribs 15 are disposed so as to replicate rotationally symmetrically at the angle of 90° from the center point O. Accordingly, around the edge portion 12, four rib groups each consisting of one tangential rib, i.e., the first rib 14, and nine inclined ribs, i.e., the second ribs 15, are arranged to appear successively.

As a result, in the edge portion 12 of the diaphragm 10 of the present embodiment, as described above, the four first ribs 14 and the 36 second ribs 15 as the recessed ribs 13 are arranged so as to include parts in which the density of the presence or absence of the recessed ribs 13 per area is low and parts in which the density is high. In this way, the rigidity and intensity of the edge portion 12 is made non-uniform, whereby the resonance frequency is dispersed. The recessed ribs 13 of the edge portion 12 improve the displacement symmetry of the diaphragm 10, thereby preventing the occurrence of troubles such as rolling of the diaphragm 10 or generation of abnormal noise, and improving the reproduced sound quality. In addition, in the case of the present embodiment, peak dipping in the sound pressure frequency characteristics is suppressed, thereby enhancing the reproduced sound quality.

The length and depth of the first ribs 14 and the second ribs 15 may be determined, as appropriate, in accordance with the shape of the edge portion 12. That is, the depth of the recessed ribs 13 from the convex surface of the edge portion 12 varies between the central position of the edge portion 12 and positions closer to the inner peripheral end or the outer peripheral end of the edge portion 12. The recessed ribs 13 are provided as long and deep grooved parts in parts of the convex edge portion 12 except for both ends thereof. The inner end of the recessed ribs 13 does not reach the outer periphery of the dome portion 11 in which the edge portion 12 is linked. The outer end of the recessed ribs 13 does not reach a planar portion of the frame 2 that is fixed to the diaphragm fixing portion 21.

Figure 3A:
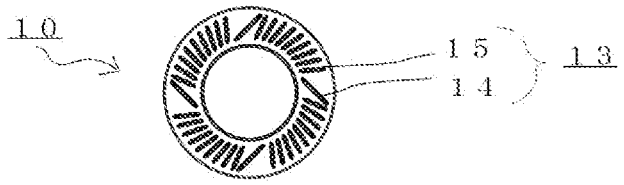
FIG. 3A and FIG. 3B are respectively a diagram illustrating the shape of a diaphragm according to an embodiment of the present invention, and a graph illustrating displacement symmetry.
Figure 3B:
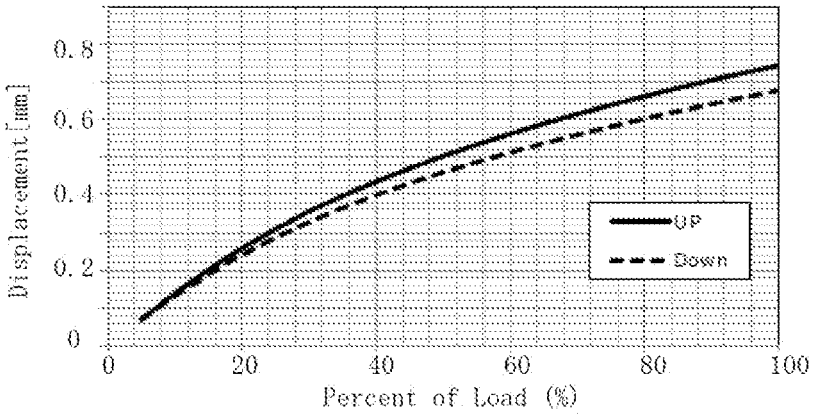
Figure 4A:
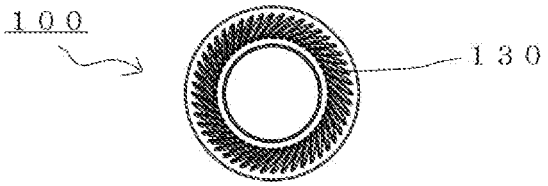
FIG. 4A and FIG. 4B are respectively a diagram illustrating the shape of a diaphragm according to a comparative example, and a graph illustrating displacement symmetry.
Figure 4B:
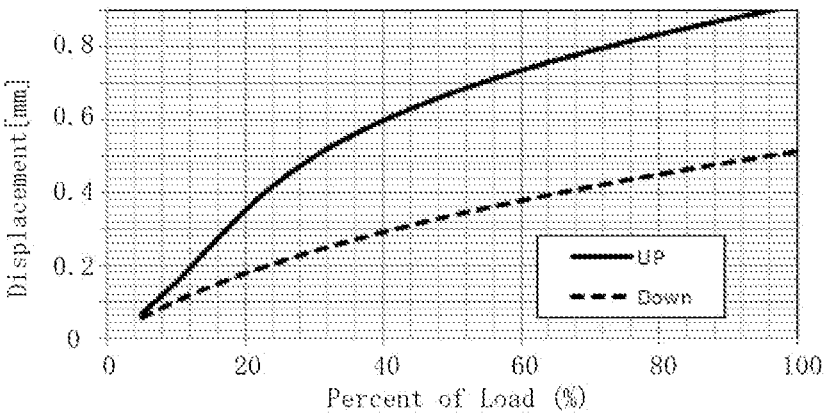
Figure 5A:
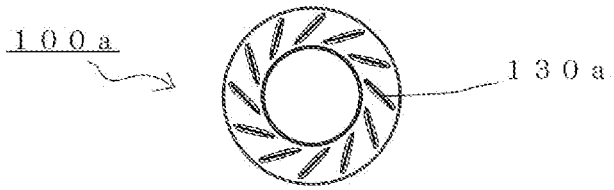
FIG. 5A and FIG. 5B are respectively a diagram illustrating the shape of a diaphragm according to another comparative example, and a graph illustrating displacement symmetry.
Figure 5B:
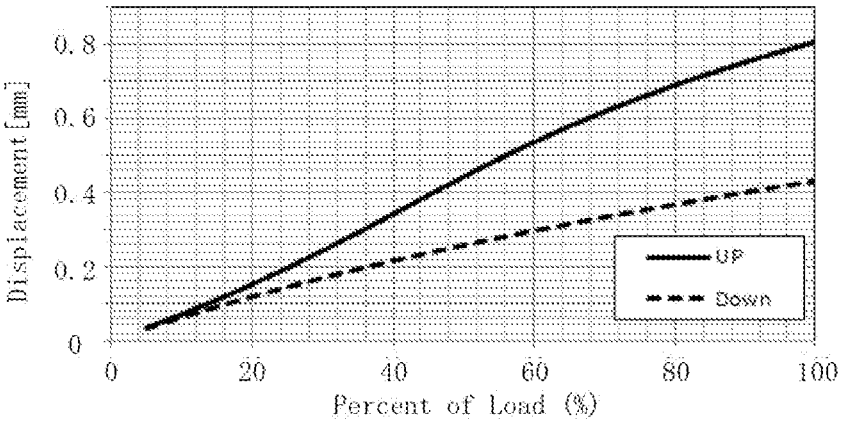

FIG. 3A, FIG. 3B, FIG. 4A, FIG. 4B, FIG. 5A, and FIG. 5B include diagrams illustrating the shape of the diaphragm 10 of the present embodiment and diaphragms 100 and 100*a* of comparative examples, and graphs indicating displacement symmetry in the Z-axis direction. Specifically, FIG. 3A, FIG. 4A, and FIG. 5A are plan views illustrating the shape of the diaphragms. The graphs of FIG. 3B, FIG. 4B, and FIG. 5B illustrating displacement symmetry are graphs of which the horizontal axis shows a value (%) scaling the drive force applied to the position at which the voice coil of the diaphragm is mounted, and the vertical axis showing the absolute value of the amount of displacement ([mm]) of the diaphragm in the Z-axis direction with respect to the drive force, in which an up direction (Up: solid line, forward direction) and a down direction (Down: dotted line, backward direction) are written over one another. In the case of an ideal diaphragm having good displacement symmetry of the edge portion 12 in the Z-axis direction, the up-direction characteristic curved line and the down-direction characteristic curved line would approach each other without being separated and would be substantially aligned with each other.

In the edge portion 12 of the diaphragm 100 of the first comparative example illustrated in FIG. 4A, 48 tangential ribs 130 as the recessed ribs are arranged rotationally symmetrically. In the edge portion 12 of the diaphragm 100*a* of the second comparative example illustrated in FIG. 5A, 12 tangential rib 130*a* as the recessed ribs are arranged rotationally symmetrically. That is, the diaphragms 100 and 100*a* of the comparative examples having the recessed ribs 130 or 130*a* disposed in the edge portion 12 thereof differ from the diaphragm 10 of the present embodiment in that the diaphragms 100 and 100*a* do not include the inclined ribs not intersecting the tangential ribs, and are similar in other settings.

Referring to the graphs of FIG. 3B, FIG. 4B, and FIG. 5B, the diaphragm 10 of the present embodiment, compared to the diaphragm 100 or 100*a* of the comparative examples, the up-direction characteristic curved line and the down-direction characteristic curved line are very close to each other, indicating good displacement symmetry of the edge portion 12 in the Z-axis direction. Thus, in the electrodynamic speaker unit 1 using the diaphragm 10, the generation of abnormal noise due to, e.g., rolling of the speaker vibration system configured from the voice coil and the diaphragm 10 can be suppressed more than in the case of the diaphragm 100 or 100*a* of the comparative examples. When the displacement symmetry of the diaphragm 10 in the Z-axis direction is good, the amounts of air discharged when the absolute values of displacement of the diaphragm 10 are equal between the up direction and the down direction become close to each other, whereby it becomes possible to suppress the generation of even-order distortion and obtain excellent reproduced sound quality.

Figure 6:
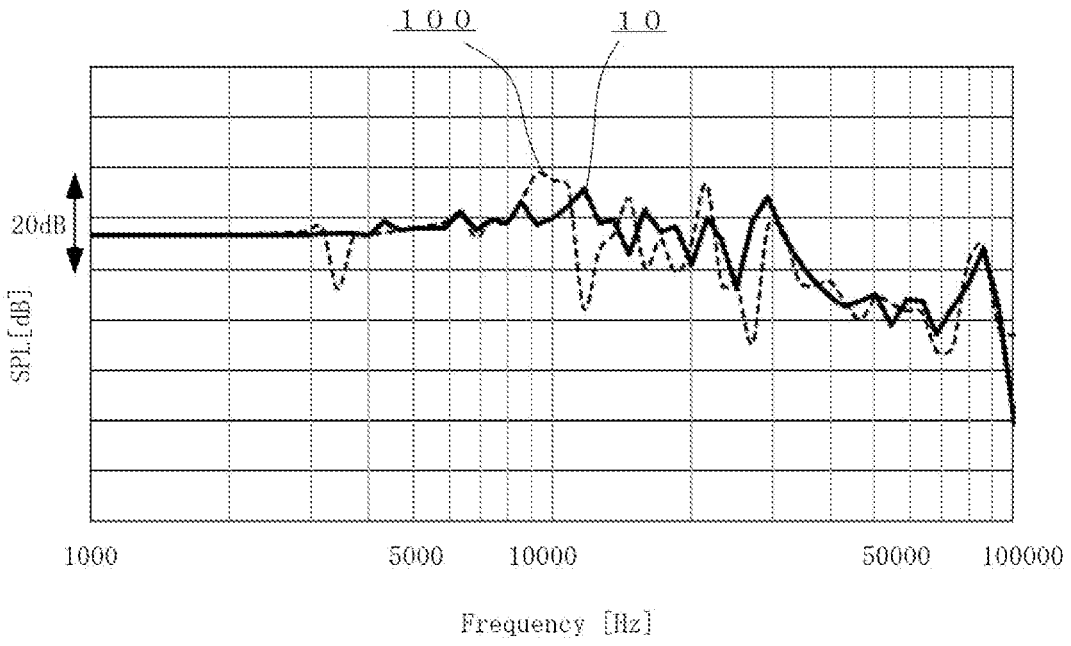
FIG. 6 is a graph illustrating the sound pressure frequency characteristics of an electrodynamic speaker unit in which the diaphragm according to an embodiment or a comparative example is used.

FIG. 6 is a graph indicating the sound pressure frequency characteristics of an electrodynamic speaker unit in which the diaphragm 10 of the present embodiment or the diaphragm 100 of the comparative example is used. The horizontal axis shows the frequency (1 kHz to 100 kHz) of an input audio signal, and the vertical axis shows the reproduced sound pressure level. In the case of the diaphragm 10 of the present embodiment, the peak dip that appears at approximately 3 k to 30 kHz in the case of the diaphragm 100 of the comparative example is suppressed. Accordingly, the electrodynamic speaker unit 1 using the diaphragm 10 of the present embodiment improves the reproduced sound quality of the headphones or earphones provided with the same.

The results of comparative listening between the headphones (not depicted) provided with the electrodynamic speaker unit 1 using the diaphragm 10 of the present embodiment and the headphones (not depicted) of the comparative example have indicated that the former provides better reproduced sound quality than the headphones of the comparative example. This is because in the case of the present embodiment, generation of unwanted sound waves, such as abnormal noise, due to rolling of the diaphragm 10 of the electrodynamic speaker unit 1 can be suppressed. It goes without saying that the electrodynamic speaker unit 1 using the diaphragm 10 may be used in earphones (not depicted) of which the housing is supported directly on the user's ears.

Figure 7A:
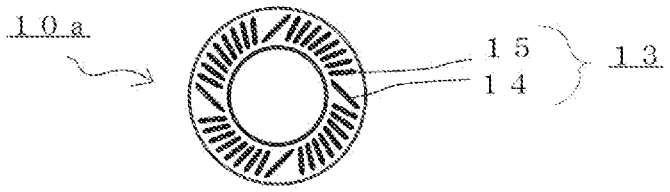
FIG. 7A and FIG. 7B respectively a diagram illustrating the shape of a diaphragm according to another embodiment of the present invention, and a graph illustrating displacement symmetry.
Figure 7B:
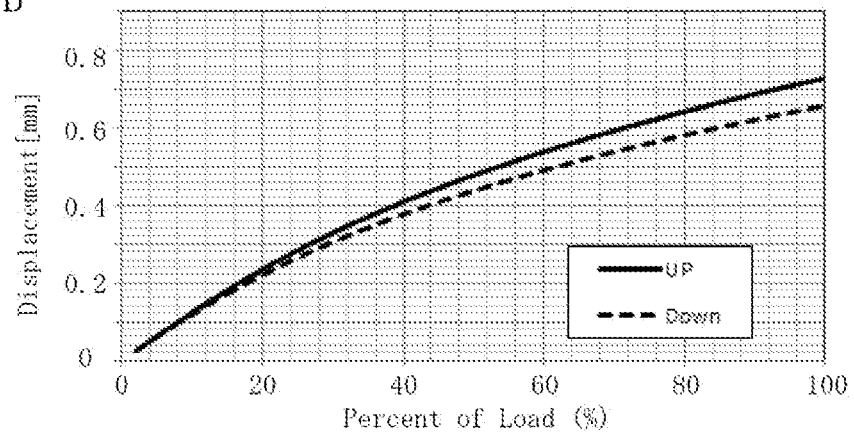
Figure 8A:
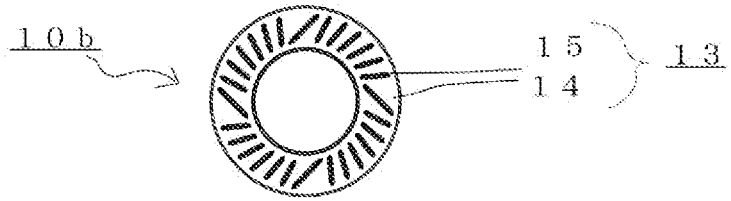
FIG. 8A and FIG. 8B are respectively a diagram illustrating the shape of a diaphragm according to another embodiment of the present invention, and a graph illustrating displacement symmetry.
Figure 8B:
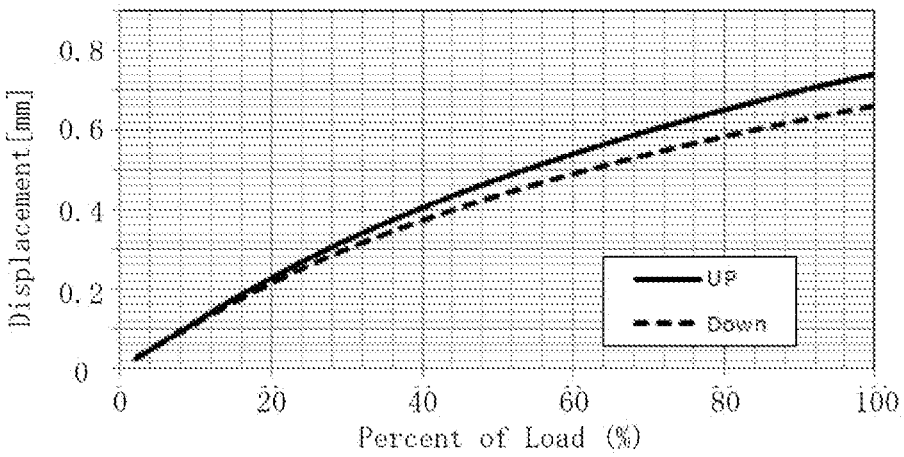
Figure 9A:
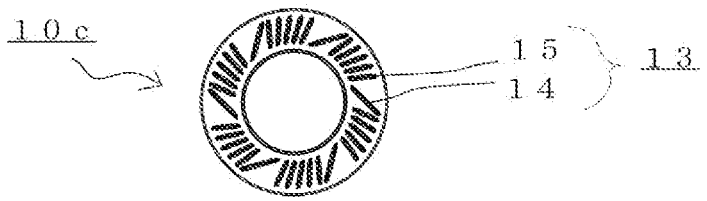
FIG. 9A and FIG. 9B are respectively a diagram illustrating the shape of a diaphragm according to another embodiment of the present invention, and a graph illustrating displacement symmetry.
Figure 9B:
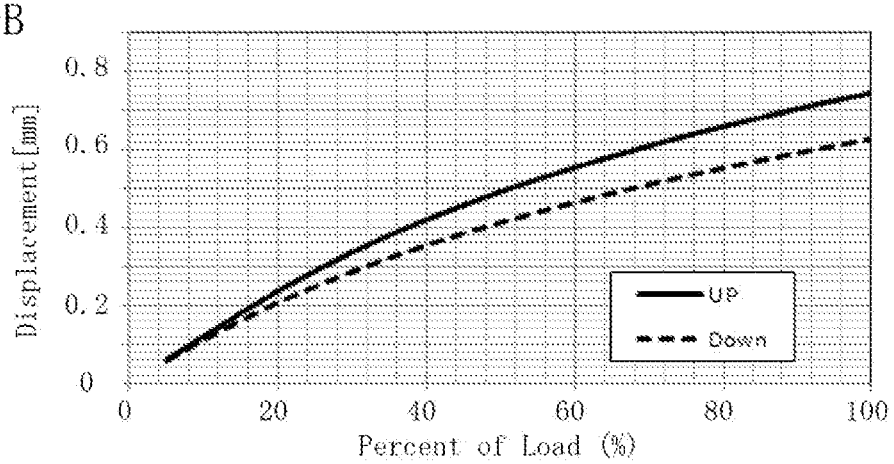

FIG. 7A, FIG. 7B, FIG. 8A, FIG. 8B, FIG. 9A, and FIG. 9B include diagrams illustrating the shape of diaphragms 10*a*, 10*b*, and 10*c* according to the second to fourth embodiments, and graphs indicating displacement symmetry in the Z-axis direction. Specifically, as in the preceding embodiment, FIG. 7A, FIG. 8A, and FIG. 9A are plan views illustrating the shape of the diaphragms, and FIG. 7B, FIG. 8B, and FIG. 9B are graphs illustrating displacement symmetry. The diaphragms 10*a*, 10*b*, and 10*c* of the second to fourth embodiments differ from the diaphragm 10 of the present embodiment in the number and interval of the first ribs 14 and the second ribs 15, and are similar in other settings.

In the edge portion 12 of the diaphragm 10*a* according to a second embodiment illustrated in FIG. 7A, the recessed ribs 13 including four first ribs 14 as the tangential ribs and 32 second ribs 15 as the inclined ribs are arranged rotationally symmetrically. The recessed second ribs 15 are formed by recessing the convex surface of the edge portion 12 so as to be disposed along the second prescribed line intersecting, at the angle φ=15°, the second radial line passing the center point O. Thus, around the edge portion 12, four rib groups each consisting of one tangential rib, i.e., the first rib 14, and eight inclined ribs, i.e., the second ribs 15, are arranged so as to appear successively.

In the edge portion 12 of the diaphragm 10*b* according to a third embodiment illustrated in FIG. 8A, the recessed ribs 13 including four first ribs 14 that are tangential ribs and 24 second ribs 15 that are inclined ribs are arranged rotationally symmetrically. The recessed second ribs 15 are formed by recessing the convex surface of the edge portion 12 so as to be disposed along the second prescribed line intersecting, at the angle φ=15°, the second radial line passing the center point O. Thus, around the edge portion 12, four rib groups each consisting of one tangential rib, i.e., the first rib 14, and six inclined ribs, i.e., the second ribs 15, are arranged so as to appear successively.

In the edge portion 12 of the diaphragm 10*c* according to a fourth embodiment illustrated in FIG. 9A, the recessed ribs 13 including six first ribs 14 as the tangential ribs and 30 second ribs 15 as the inclined ribs are arranged rotationally symmetrically. The recessed second ribs 15 are formed by recessing the convex surface of the edge portion 12 so as to be disposed along the second prescribed line intersecting, at an angle φ=15°, the second radial line passing the center point O. Thus, around the edge portion 12, six rib groups each consisting of one tangential rib, i.e., the first rib 14, and five inclined ribs, i.e., the second ribs 15, are arranged so as to appear successively.

Referring to the graphs of FIG. 7B, FIG. 8B, and FIG. 9B, in the case of the diaphragm 10*a*, 10*b*, and 10*c* of the present embodiment, as in the case of the diaphragm 10 of the preceding embodiment, compared to the diaphragm 100 or 100*a* of the comparative examples, the up-direction characteristic curved line and the down-direction characteristic curved line are fairly close to each other, resulting in good displacement symmetry of the edge portion 12 in the Z-axis direction. Accordingly, the electrodynamic speaker unit 1 using the diaphragm 10*a*, 10*b*, or 10*c* can suppress the generation of abnormal noise due to, e.g., rolling of the speaker vibration system configured from the voice coil and the diaphragm 10, compared to the diaphragm 100 or 100*a* of the comparative examples. When the displacement symmetry of the diaphragm 10*a*, 10*b*, and 10*c* in the Z-axis direction is good, the amounts of air discharged when the absolute values of displacement of the diaphragms 10*a*, 10*b*, and 10*c* are equal between the up direction and the down direction become close to each other, whereby it becomes possible to suppress the generation of even-order distortion, and to obtain excellent reproduced sound quality.

Figure 10A:
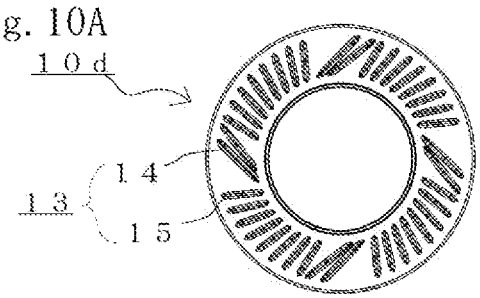
FIG. 10A, FIG. 10B, and FIG. 10C are diagrams illustrating the shapes of diaphragms according to other embodiments of the present invention.
Figure 10C:
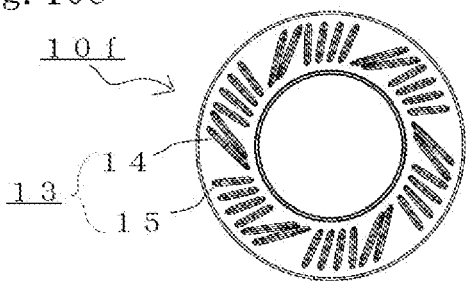
Figure 10B:
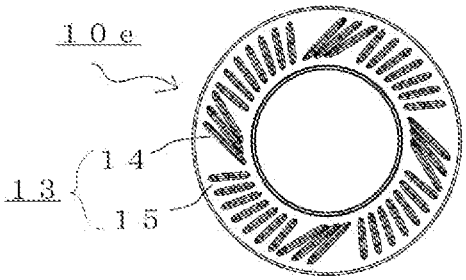

FIG. 10A to FIG. 10C are plan views illustrating the shapes of diaphragms 10*d*, 10*e*, and 10*f* according to fifth to seventh embodiments. Specifically, as in the foregoing embodiments, FIG. 10A depicts the shape of the diaphragm 10*d*; FIG. 10B depicts the shape of the diaphragm 10*e*; and FIG. 10C depicts the shape of the diaphragm 10*f*. The diaphragms 10*d*, 10*e*, and 10*f* of the fifth to seventh embodiments differ from the diaphragms 10 to 10*c* of the foregoing embodiments in the number and interval of the first ribs 14 and the second ribs 15, and are similar in other settings. In particular, in the diaphragms 10*d*, 10*e*, and 10*f* of the fifth to seventh embodiments, a plurality of first ribs 14 is arranged adjacent to each other, forming a rib group of the first ribs 14. The rib group of the first ribs 14 is arranged between at least two second ribs 15.

In the edge portion 12 of the diaphragm 10*d* of the fifth embodiment illustrated in FIG. 10A, the recessed ribs 13 including eight first ribs 14 that are tangential ribs and 32 second ribs 15 that are inclined ribs are arranged rotationally symmetrically. The first ribs 14 include two recessed tangential ribs arranged adjacent to each other. The recessed second ribs 15 are formed by recessing the convex surface of the edge portion 12 so as to be disposed along the second prescribed line intersecting, at the angle φ=15°, the second radial line passing the center point O. Thus, around the edge portion 12, four rib groups each consisting of two tangential ribs, i.e., the first ribs 14, and eight inclined ribs, i.e., the second ribs 15, are arranged so as to appear successively.

In the edge portion 12 of the diaphragm 10*e* according to the sixth embodiment illustrated in FIG. 10B, the recessed ribs 13 including 12 first ribs 14 that are tangential ribs and 28 second ribs 15 that are inclined ribs are arranged rotationally symmetrically. The first ribs 14 include three recessed tangential ribs arranged adjacent to each other. The recessed second ribs 15 are formed by recessing the convex surface of the edge portion 12 so as to be disposed along the second prescribed line intersecting, at the angle φ=15°, the second radial line passing the center point O. Thus, around the edge portion 12, four rib groups each consisting of three tangential ribs, i.e., the first ribs 14, and seven inclined ribs, i.e., the second ribs 15 are arranged so as to appear successively.

In the edge portion 12 of the diaphragm 10*f* according to the seventh embodiment illustrated in FIG. 10C, the recessed ribs 13 including 12 first ribs 14 that are tangential ribs and 24 second ribs 15 that are inclined ribs are arranged rotationally symmetrically. The first ribs 14 include two recessed tangential ribs arranged adjacent to each other. The recessed second ribs 15 are formed by recessing the convex surface of the edge portion 12 so as to be disposed along the second prescribed line intersecting, at the angle φ=15°, the second radial line passing the center point O. Thus, around the edge portion 12, six rib groups each consisting of two tangential ribs, i.e., the first ribs 14, and four inclined ribs, i.e., the second ribs 15, are arranged so as to appear successively.

In the diaphragms 10*d*, 10*e*, and 10*f* of the present embodiments, as in the diaphragms 10 to 10*c* of the preceding embodiments, compared to the diaphragm 100 or 100*a* of the comparative examples, the up-direction characteristic curved line and the down-direction characteristic curved line are fairly close to each other, and good displacement symmetry of the edge portion 12 is obtained in the Z-axis direction. Accordingly, the electrodynamic speaker unit 1 using the diaphragms 10*d*, 10*e*, and 10*f* can suppress generation of abnormal noise due to, e.g., rolling of the speaker vibration system configured from the voice coil and the diaphragm 10, compared to the diaphragm 100 or 100*a* of the comparative examples.

As described in the foregoing embodiments, as the recessed ribs 13 in the edge portion 12, the first ribs 14 that are tangential ribs and the second ribs 15 that are inclined rib may be arranged at least adjacent to each other and without intersecting each other. Because the first ribs 14 that are tangential ribs are disposed along the first prescribed line intersecting at the angle of 45° the first radial line passing the center point, the second ribs 15 may be disposed along the second prescribed line intersecting the second radial line at a predetermined angle of less than 45°. Rib groups in each of which the first ribs 14 and the second ribs 15 are formed adjacent to each other may be arranged so as to appear alternately around the edge portion 12.

The resin material of the diaphragm 10 is not limited to the film-like member of PET according to the foregoing embodiments. The material of the diaphragm 10 may include: lightweight films of other resin materials, such as polyetheretherketone (PEEK), polyetherimide (PEI), polyethylene naphthalate (PEN), polycarbonate (PC), polyimide (PI), polyarylate (PAR), and polyphenylene sulfide (PPS); sheets that have been formed by heat-pressing; and elastomer sheets that have been press-molded. The material of the diaphragm 10 may include non-woven cloth configured from natural fibers, such as cellulose, or synthetic fibers, or paper material. The diaphragm 10 may include layers of a plurality of materials. For example, when resin films of PEEK, PEI, PEN and the like are laminated, an intermediate layer of an elastomer sheet, or an adhesive layer may be interposed.

The voice coil 3 may be linked to a voice coil attachment portion defined on the outer periphery of the dome portion 11, so that the diaphragm 10 can be handled as an assembly component of a speaker vibration system constituting the electrodynamic speaker unit 1. The shapes and dimensions of the dome portion 11 and the edge portion 12, including the dimension of the curved surface beveling the ridge portions of the recessed ribs 13, may be modified in accordance with the diameter dimension of the voice coil 3 and the thickness dimension of the resin material of the diaphragm 10. The dome portion 11 of the diaphragm 10 of the present embodiment may have the shape of a partial spherical surface, as in the foregoing embodiments. It is also possible to provide the dome portion 11 with reinforcing ribs of recessed or convex grooves.

In the diaphragm 10, the dome portion 11 may be configured from a member different from the edge portion 12, and may be linked with the central side of the edge portion 12. That is, the dome portion 11 configured from a member different from the sheet-like or film-like member constituting the edge portion 12 may be linked with the central side of the edge portion 12.

The frame 2 of the present embodiment, due to the adoption of the resin material containing a polyphenylene ether resin, a polystyrene resin, and a polyolefin resin at specific ratios as described above, has a high internal loss and excellent mechanical characteristics in a well-balanced manner, is lightweight, and provides excellent heat resistance and S/N ratio. However, the frame 2 may be configured from other resin materials or metal materials having different ratios.

The diaphragm of the present invention is not limited to the electrodynamic speaker unit illustrated in the drawings, and may be applied to a speaker unit that constitutes a speaker vibration system additionally provided with a damper. The diaphragm is not limited to electrodynamic speaker units and may be applied to piezoelectric speaker units.

What is claimed is:

1. A diaphragm comprising an annular edge portion having a convex radial cross section formed by molding a sheet-like member or a film-like member, wherein: the edge portion includes a plurality of rotationally symmetrical recessed ribs formed by recessing a convex surface; and the plurality of recessed ribs includes at least a first rib disposed along a first prescribed line intersecting, at an angle of 450, a first radial line passing a center point, and at least a second rib which is disposed in a position not intersecting but adjacent to the first rib, and which is disposed along a second prescribed line intersecting a second radial line at a predetermined angle of less than 45°.

2. The diaphragm according to claim 1, wherein the plurality of recessed ribs further includes one or a plurality of the second ribs arranged adjacent to each other by replicating the second rib rotationally symmetrically by a predetermined angle from the center point, wherein a second rib group of the plurality of adjacent second ribs is disposed between at least two of the first ribs in the edge portion.

3. The diaphragm according to claim 1, wherein the plurality of recessed ribs further includes one or a plurality of the first ribs arranged adjacent to each other by replicating the first rib rotationally symmetrically by a predetermined angle from the center point, wherein a first rib group of the plurality of adjacent first ribs is disposed between at least two of the second ribs in the edge portion.

4. The diaphragm according to claim 1, wherein a dome portion configured from a member different from the sheet-like member or the film-like member and having a convex radial cross section is linked with a central side of the edge portion.

5. The diaphragm according to claim 4, further comprising a voice coil linked with a voice coil attachment portion defined on an outer peripheral portion of the dome portion.

6. A speaker unit comprising:

the diaphragm according to claim 5;

a frame to which an outer peripheral end portion of the edge portion of the diaphragm is fixed;

a terminal which is fixed to the frame and to which a coil of the voice coil is connected;

a magnetic circuit including a magnetic gap in which the coil of the voice coil is disposed, the magnetic circuit being fixed to the frame; and a braking member mounted so as to cover an opening of a window portion of the frame.

7. A headphone or earphone comprising the speaker unit according to claim 6.

8. The diaphragm according to claim 1, wherein a dome portion having a convex radial cross section is configured on a central side of the edge portion integrally with the edge portion by molding the sheet-like member or the film-like member.

* * * * *